United States Patent [19]

Fane

[11] 3,998,080

[45] Dec. 21, 1976

[54] FRANGIBLE CONSTRUCTION LOCK SYSTEM

[75] Inventor: William J. Fane, North Vancouver, Canada

[73] Assignee: Norris Industries, Inc., South Gate, Calif.

[22] Filed: Apr. 30, 1975

[21] Appl. No.: 573,067

[52] U.S. Cl. ..... 70/338; 70/364 A; 70/370; 70/384

[51] Int. Cl.[2] ..... E05B 35/08; E05B 27/00; E05B 25/00

[58] Field of Search ..... 70/338, 340, 342, 364 R, 70/364 A, 376, 378, 383, 384, 385, 410, 422

[56] References Cited

UNITED STATES PATENTS

| | | | |
|---|---|---|---|
| 564,029 | 7/1896 | Sargent | 70/364 A X |
| 3,070,987 | 1/1963 | Baker et al. | 70/338 X |
| 3,095,726 | 7/1963 | Schlage | 70/383 |
| 3,149,486 | 9/1964 | Russell et al. | 70/384 |
| 3,172,284 | 3/1965 | Crandell et al. | 70/383 |
| 3,175,379 | 3/1965 | Russell et al. | 70/384 X |
| 3,190,093 | 6/1965 | Schlage | 70/383 |
| 3,234,768 | 2/1966 | Russell et al. | 70/338 X |
| 3,315,503 | 4/1967 | Schlage | 70/383 |
| 3,563,071 | 2/1971 | Barger | 70/378 X |

*Primary Examiner*—Paul R. Gilliam
*Assistant Examiner*—A. M. Calvert

[57] ABSTRACT

A pin tumbler lock has a housing, a cylindrical key plug provided with a keyway rotatable in the housing, a shear line between the plug and the housing, pin tumbler bores with aligned parts respectively in the housing and the key plug and spring pressed outer and inner pin tumblers in each bore. In one of the bores is an extra frangible graphite tumbler of substantially the diameter of the other pin tumblers. When construction key is inserted in the keyway the graphite tumbler and the other pin tumblers meets at the shear line permitting the lock to unlock. When construction is finished a conversion key is inserted in the keyway and the graphite tumbler is shifted to a position crossing the shear line whereupon the graphite tumbler is shattered by rotation of the key plug. Thereafter the lock can not be unlocked by the construction key but can be unlocked by the householder's key.

13 Claims, 10 Drawing Figures

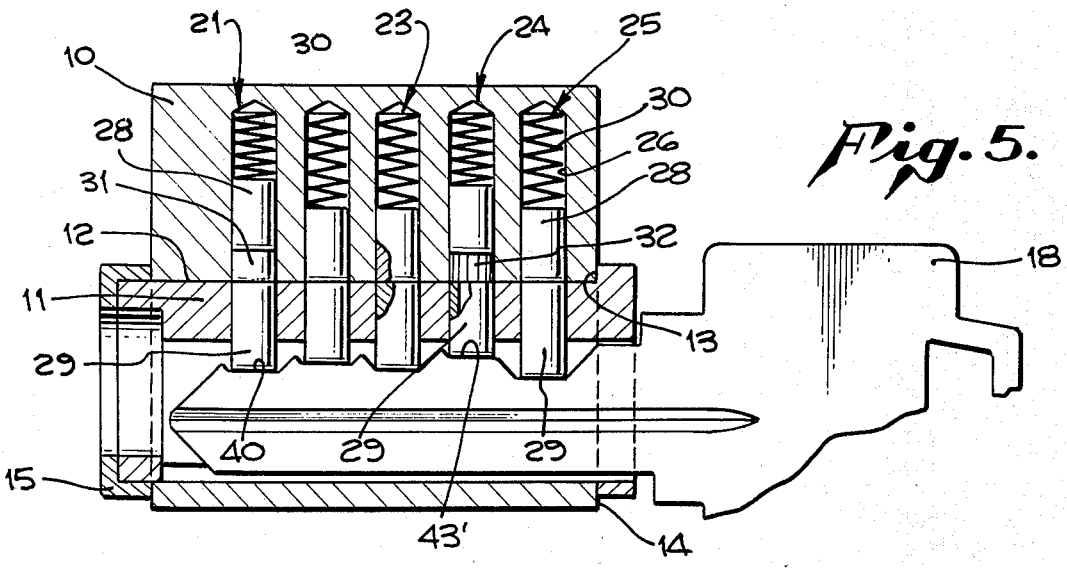
Fig. 5.
Fig. 6.
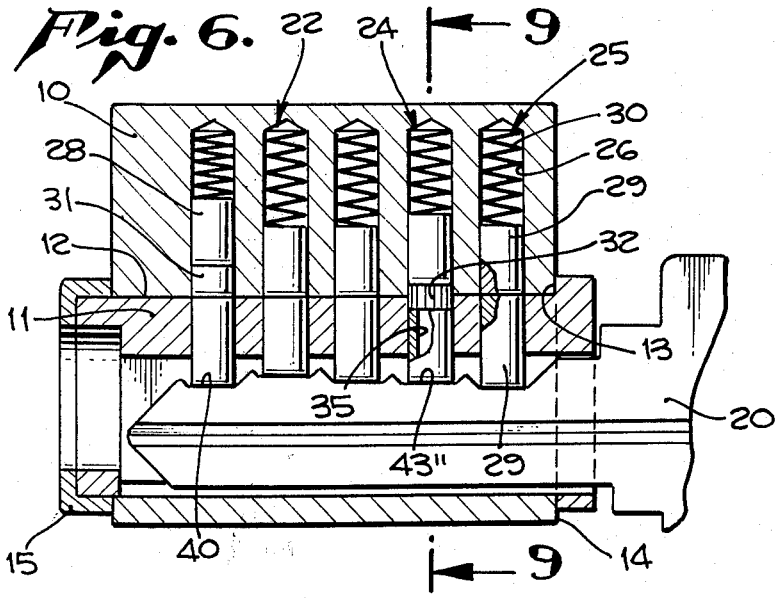
Fig. 9.
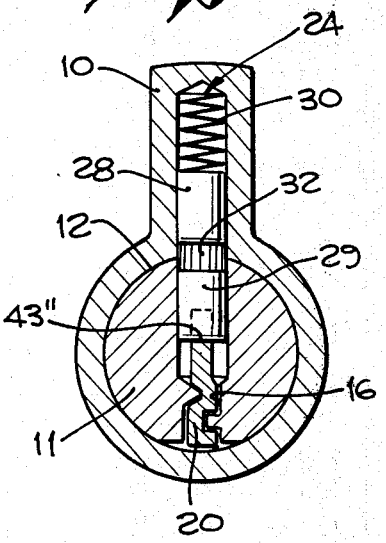
Fig. 7.
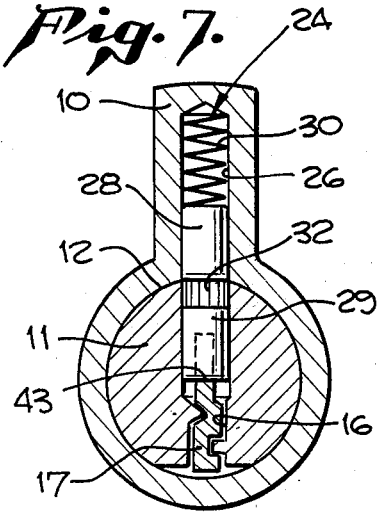
Fig. 8.
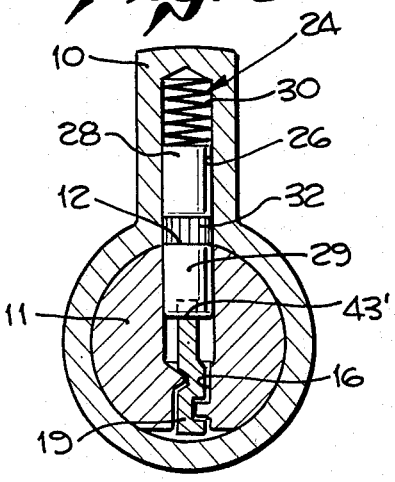
Fig. 10.
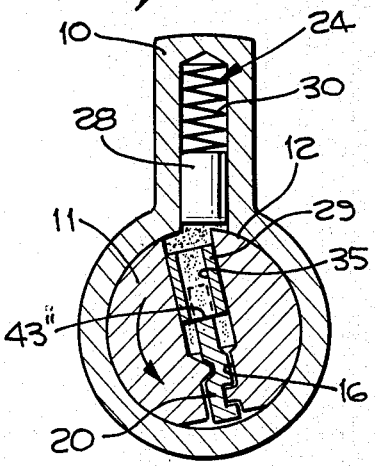

FRANGIBLE CONSTRUCTION LOCK SYSTEM

When newly constructed buildings such for example as apartment complexes and houses reach a certain stage, locks are customarily installed and thereafter workmen need to lock and unlock the doors. Clearly there are a great variety of workmen during construction and where keys are possessed by all manner of working personnel locks need ultimately to be changed when the owner or householder takes possession.

Although rekeying of locks can be accomplished by commonly known expedients, such for example, as the removal of the cylinder plug and replacement with another, such an operation can be unnecessarily time consuming, especialy when a relatively large number of locks have to be rekeyed. When resort is had to such rekeying there must naturally be available a corespondng amount of extra cylinder plugs.

Improvements on this technique have prompted an assortment of expedients whereby one or more pin tumblers or pin tumbler parts are arranged to be separated or broken and ejected thereby to repin the cylinder plug without requiring removal of the cylinder plug from the lock. With this expedient the temporary or construction key can then no longer operate the lock but the lock can be operated at will by the owner's change key. Examples of such patents include U.S. Pat. Nos. 2,591,652; 3,070,987; 3,078,705; 3,149,486; 3,175,369, 3,234,768; 3,276,233; and 3,395,558.

Another approach has been to make use of a frangible block of some kind, usually made of graphite, capable of holding at least one of the sets of pin tumblers in an unlocked position so that a shorter key employed as a temporary key is capable of being used to unlock the lock until the frangible block has been broken after which only the householder's or owner's key which is longer can be used to successfuly unlock the lock. Examples of such structures include U.S. Pat. Nos. 3,099,151 and 3,172,284.

Structures of the type heretofore available have had disadvantages, one being that the lock could not be inspected for operation by all keys, expecially the ultimate owners key and master key when initially shipped with the frangible element in place. Other defects have included an inability to effectively dispose of an extra ball or tumbler with a degree of certainty required of locks of this kind. Also most of such locks have required extra machining operations for the accommodation of some part which must be temporarily held and then disposed of, thereby adding unnecessarily to the initial cost of the lock.

It is therefore among the objects of the invention to provide a new and improved frangible construction lock system which is such that all keys including the temporary key, the ultimate owner's change key and master key are of the same length and with key cuts so located that the operation of keying can be inspected for all keys even though the frangible element is installed in an operating relationship at the factory.

Another object of the invention is to provide a new and improved frangible construction lock system wherein installation of the frangible element requires no machining operations other than those normally employed in a conventional pin tumbler lock.

Still another object of the invention is to provide a new and improved frangible construction lock system wherein all of the sets of pin tumblers are used both during the construction period and subsequent thereto, the expedient being merely to destroy one extra frangible tumbler element to accomplish the necessary rekeying.

Still another object of the invention is to provide a new and improved frangible construction lock system wherein the frangible element can be located in any one or another of the pin tumbler bores or in which if desired frangible elements can be located in two or more bores, without necessitating any change in the structure of the lock.

Still further among the objects of the invention is to provide a new and improved frangible construction lock system wherein the cost of constructing the lock to accept the frangible expedient is no more than the cost to construct a conventional lock, the extra cost being confined to the provision of the frangible element itself and its insertion into one of the pin tumbler bores.

With these and other objects in view, the invention consists of the construction, arrangement, and combination of the various parts of the device, whereby the objects contemplated are attained, as hereinafter set forth, pointed out in the appended claims and illustrated in the accompanying drawings.

FIG. 5 is a view similar to FIG. 3 but with a change key in place.

FIG. 6 is a view similar to FIG. 3 but with a conversion key in place.

FIG. 7 is a cross-sectional view on the line 7 — 7 of FIG. 3.

FIG. 9 is a cross-sectional view on the line 8 — 8 of FIG. 4.

FIG. 9 is a cross-sectional view on the line 9 — 9 of FIG. 6.

FIG. 10 is a view similar to FIG. 9 but at the moment of destruction of the frangible tumbler.

Figure 1:
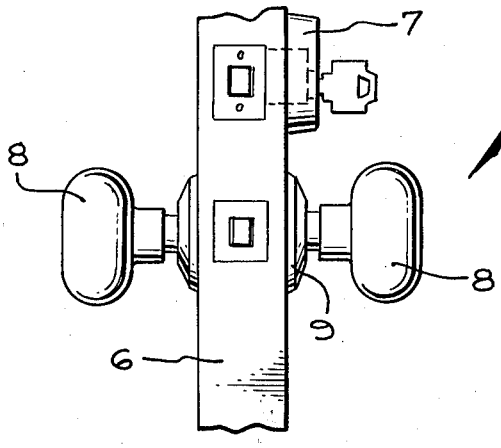
FIG. 1 is an end elevational view of a lock installation in a door.
Figure 2:
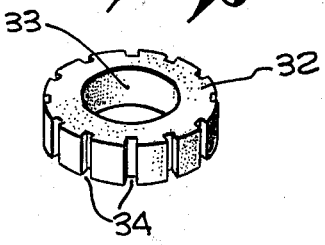
FIG. 2 is a perspective view of one of the frangible tumblers.

FIG. 1 shows a door 6 in which is installed a lock set 7 which contains the invention, the door being provided with knobs 8 forming parts of a conventional passage lock set 9.

In an embodiment of the invention chosen for the purpose of illustration there is shown a typical pin tumbler lock which consists of a housing 10 within which rotates a key actuated cylinder plug 11 which forms with the housing a shear line 12. On the cylinder plug is a shoulder 13 bearing against a front face 14 of the housing, against which it is drawn by application of a sleeve 15 whereby to hold the cylinder plug 11 in place in the housing 10 in a substantially conventional manner. In the cylinder plug is a keyway 16 which is adapted to receive any one or a set of keys like the temporary construction key 17, an owner's or householder's change key 18, a master key 19, and a conversion key 20.

In the chosen embodiment there are employed five pin tumbler bores 21, 22, 23, 24, and 25, although the system is operable with an additional number of pin tumbler bores. Each of the pin tumbler bores has one part 26 in the housing and another part 27 in the cylinder plug.

For each of the bores there is a set of pin tumblers which in the case of most of the bores, consists of an outer pin tumbler 28 and an inner pin tumbler 29, the outer pin tumbler being in the part 26 and the inner pin tumbler being in the part 27. A spring 30 retained in the bore normally presses the outer pin tumbler inwardly toward the shear line 12.

In the case of the bore 21 there is an extra conventional tumbler 31 which is made use of by the master key.

In the pin tumbler bore 24 in the chosen embodiment there is a third frangible tumbler or wafer 32 shown located between the outer pin tumbler 28 and the inner pin tumbler 29. Although only one of the bores is shown provided with a frangible tumbler, two or more bores may be so fitted, especially in pin tumbler make ups where there may be a greater number of pin tumbler bores than five. Since the frangible tumbler is ultimately to be destroyed the frangible tumbler is provided with a hollow interior 33, which may if preferred be grooved, and axially extending grooves 34 on the exterior. A construction of the kind described encourages the frangible tumbler to break up into very small fragments when it is crushed. Forming it as a hollow cylinder permits it to collapse on itself so that its effective length is changed immediately upon being crushed. A recess 35 in the inner pin tumbler 29 may be provided to receive chips of the frangible tumbler when it is destroyed.

Normally with no key inserted in the keyway pin tumblers in each of the pin tumbler bores will lie across the shear line and prevent rotation of the cylinder plug by unauthorized means. With the construction key 17 fully inserted into the keyway 16 the inner tumblers are all lifted by appropriate cuts 40, 41, 42, 43, and 44 so that their upper ends coincide with the shear line 12. The corresponding outer tumblers are pushed against pressure of the respective springs so that the inner lines of those tumblers also coincide with the shear line.

Figure 3:
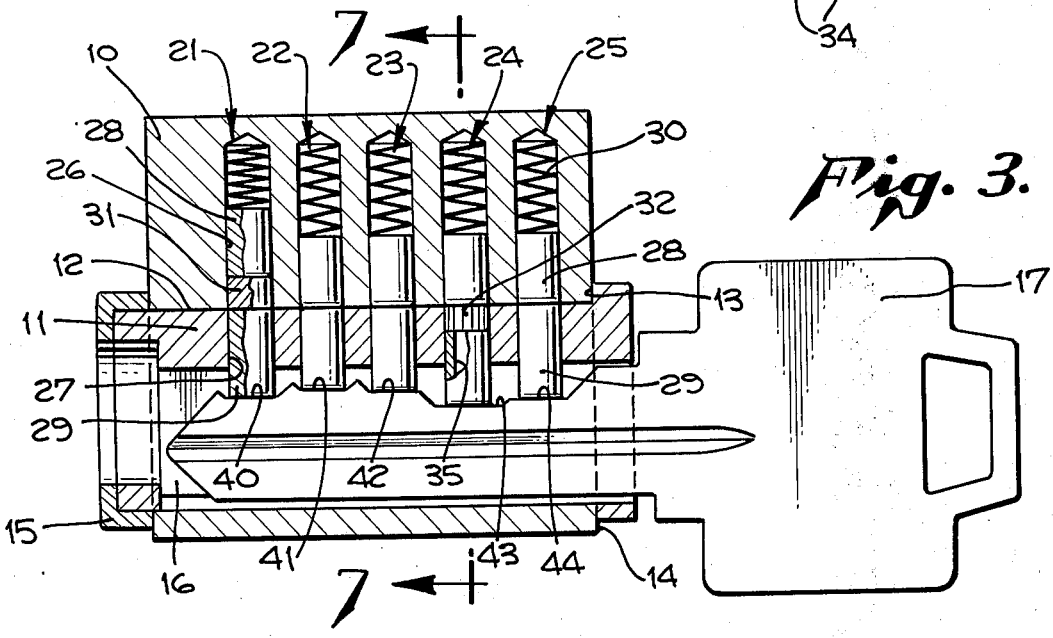
FIG. 3 is a longitudinal sectional view of the lock with the construction key in place.

There is however a special condition in the pin tumbler bore 24 wherein the cut 43 of the construction key is made sufficiently deep that it will allow the spring to push the outer tumbler 28 against the frangible tumbler 32 which, being of appropriate length, has its outer end and the inner end of the outer tumbler 28 coincide with the shear line thereby to permit rotation of the cylinder plug by the construction key, as shown in FIG. 3.

Figure 4:
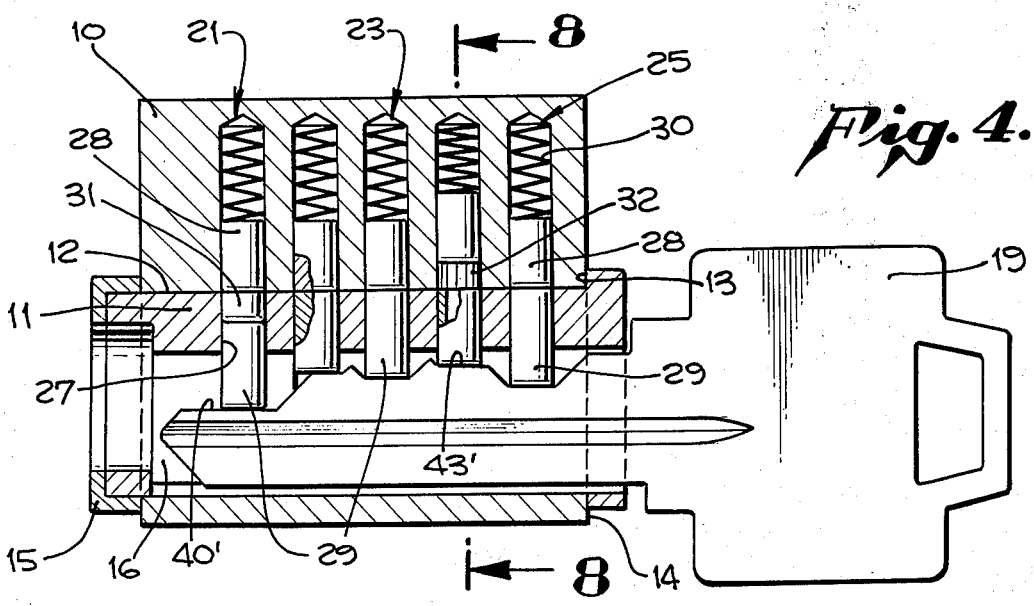
FIG. 4 is a view similar to FIG. 3 but with a master key in place.

When the change key 18 is inserted in the keyway 16, as shown in FIG. 4, much the same positioning of tumblers is accomplished except that the cut 43' of the change key is higher to the extent that it lifts the frangible tumbler 32 to a position where the inner end of the frangible tumbler coincides with the shear line as does the outer end of the inner tumbler 29. In this adjustment the cylinder plug 11 can be rotated to unlock the lock by use of the change key.

Also when the master key 19 is inserted, as shown in FIG. 4, a corresponding positioning of the pin tumblers takes place except within the bore 21. Because of the lower position of the cut 40' of the master key the spring 30 pushes the outer tumbler 28 and also the extra tumbler 31 inwardly until the junction of the outer end of the extra tumbler 31 and inner end of the outer tumbler 28 coincide with the shear line thereby to enable rotation of the cylinder plug to unlock the lock. A master key may have the special cut 40' in alignment with any one of the other four pin tumbler bores. A shallow cut at the location of the cut 40' may also be employed with appropriate pin tumbler size and spacing.

When construction has finished and the time has come to render the lock non-operable by anyone owning a construction key the conversion key 20 is inserted in the keyway 16. The cuts of the conversion key are similar to those of the change key with one exception, namely, the location of the cut 43''. The level of this cut is made such that the inner tumbler 29 and the frangible tumbler 32 is lifted to a position such that the frangible tumbler 32 crosses the shear line 12. This would normally prevent rotation of the cylinder plug except that when the conversion key forcibly rotates the cylinder the shear action destroys the frangible tumbler 32.

The frangible material thus released in the interior of the lock breaks up and in effect becomes a dry lubricant. The space previously occupied by the frangible tumbler 32 then becomes empty. As a consequence, the outer tumbler 28 of the bore 24 is moved against the inner tumbler 29 and, when no key is in place, crosses the shear line 12. Thereafter, should the construction key be inserted, the deep cut 43 of the construction key would not be sufficient to lift the inner tumbler 29 so as to coincide with the shear line and as a consequence the construction key can no longer unlock the lock. The remaining keys namely the change key and the master key, since they have the cuts 43' at a level such as to lift the inner tumbler 29 so that its top coincides with the shear line 12, enable the cylinder plug to be rotated so that the lock can be unlocked.

Because of the fact that all keys are of the same length and have cuts to manipulate the pin tumblers in all of the bores all of the keys namely, the construction key, the change key, and the master key can be checked for proper operation when the frangible tumbler 32 is in position which would be the assembly when the lock is shipped to the job. This allows the lock to be inspected for proper keying of all keys before it is shipped from the source of supply to the construction site, thereby to assure that the master key and change key will operate after the frangible tumbler has been destroyed.

Although the frangible tumbler 32 has been shown located in one of the bores, intermediate the opposite end bores, the system is such that the frangible tumbler can be located in the bore at either end or in any one of the intermediate bores. Further, although only one frangible tumbler has been illustrated, two or more frangible tumblers could be employed in a system of this description should there be need for such additional precaution.

The invention provides a further help in prevention of unauthorized key duplication in that the frangible tumblers can be made of different lengths. This added to capability of locating the frangible tumbler in any one of the pin tumbler bores, and having master keying available at any of such locations, adds greatly to the number of combinations which can be employed.

Having described the invention, what is claimed as new in support of Letters Patent is as follows:

1. A frangible construction lock system comprising a housing, a cylindrical key plug rotatably mounted in said housing productive of a shear line between said housing and said plug, means forming a keyway in said plug, a plurality of tumbler bores with aligned parts respectively in said housing and said plug, spring pressed outer tumblers in the housing parts of the bores and inner tumblers in the plug parts of the bores, an extra frangible tumbler separate from the respective outer and inner tumblers in one of said bores at a location inwardly with respect to the outer tumbler and a plurality of keys, one of said keys being a temporary key having a cut for the bore with the frangible tumbler at a level which places the outer end of said frangible tumbler at the shear line for enabling rotation of the plug, a conversion key having a cut for the bore with the frangible tumbler at a level which places said frangible tumbler across the shear line whereby upon rotation of said plug the frangible tumbler is destroyed, and another key having a cut for the bore with the frangible tumbler at a level which places the outer end of the inner tumbler at the shear line for enabling rotation of the plug by said other key.

2. A frangible construction lock system as in claim 1 wherein the frangible tumbler is located intermediate the outer tumbler and the inner tumbler.

3. A frangible construction lock system as in claim 1 wherein the frangible tumbler is in one of the bores intermediate the opposite end bores.

4. A frangible construction lock system as in claim 1 wherein the cross sectional area of the frangible tumbler is less than the cross sectional area of the bore.

5. A frangible construction lock system as in claim 1 wherein the frangible tumbler is tubular presenting inner and outer walls and there are alternating circumferentially spaced axial recesses on one of said walls.

6. A frangible construction lock system as in claim 1 wherein the temporary key has the same number of cuts as does the change key.

7. A frangible construction lock system as in claim 1 wherein one of the bores has an extra non-frangible tumbler and a master key having a cut for the bore containing said extra non-frangible tumbler, said cut being at a level which enables the extra non-frangible tumbler to shift so that one end thereof is at the shear line, said one end being the end opposite the end at the shear line when the temporary key is in the key plug.

8. A frangible construction lock system as in claim 1 wherein all of the keys have the same number of cuts.

9. A frangible construction lock system as in claim 1 wherein there are frangible tumblers in a plurality of said bores.

10. A frangible construction lock system as in claim 1 wherein there is a recess in the inner tumbler adjacent the frangible tumbler for reception of fragmented portions of the frangible tumbler when said frangible tumbler is destroyed.

11. A frangible construction lock system as in claim 1 wherein the frangible tumbler has a hollow tubular interior.

12. A frangible construction lock system as in claim 1 wherein the material of the frangible tumbler becomes a lubricant.

13. A frangible construction lock system as in claim 7 wherein said master key has a cut for the bore containing the frangible tumbler at a level which places the outer end of the inner tumbler of said last identified bore at the shear line.

* * * * *